US006375295B1

(12) United States Patent
Ghozeil et al.

(10) Patent No.: US 6,375,295 B1
(45) Date of Patent: Apr. 23, 2002

(54) REDUCED EMI PRINTHEAD APPARATUS AND METHOD

(75) Inventors: Adam L. Ghozeil; Michael J. Barbour; Jeffery S. Beck, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/253,302

(22) Filed: Feb. 19, 1999

(51) Int. Cl.[7] ..... B42J 29/38
(52) U.S. Cl. ..... 347/12; 347/9
(58) Field of Search ..... 347/12, 11, 9, 347/5

(56) References Cited

U.S. PATENT DOCUMENTS 4,026,401 A * 5/1977 Doane
4,201,488 A * 5/1980 Gosset et al. ..... 400/121
4,750,010 A * 6/1988 Ayers et al. ..... 346/107
5,428,376 A 6/1995 Wade et al. ..... 347/14
5,508,724 A 4/1996 Boyd et al. ..... 347/58
5,867,203 A * 2/1999 Jones et al. ..... 347/251
6,149,259 A * 11/2000 Otsuka et al. ..... 347/12
6,280,012 B1 * 8/2001 Schloemann et al. ..... 347/12

OTHER PUBLICATIONS

Stan Gibilisco, The Illustrated Dictionary of Electronics, 7th ed., McGraw–Hill, 1997, p. 175.*
Texas Instruments, Data Sheet SDLS157, Mar. 1998, pp. 1–4.*

* cited by examiner

*Primary Examiner*—John Barlow
*Assistant Examiner*—Alfred Dudding

(57) ABSTRACT

A printhead apparatus and accompanying method that achieve a staggered firing of multiple firing chambers within a firing interval to reduce EMI caused by multiple firing signal current transitions. The staggered firings may be achieved by delaying firing signals relative to others. The induced delay is preferably sufficient to reduce EMI while not being sufficient to noticeably affect image quality.

20 Claims, 3 Drawing Sheets

REDUCED EMI PRINTHEAD APPARATUS AND METHOD

FIELD OF THE INVENTION

The present invention relates to ink jet and like printers and, more specifically, to modifying firing signal timing therein to reduce electromagnetic interference caused by firing signal transitions.

BACKGROUND OF THE INVENTION

Many types of printers are known and they include ink jet, laser and various thermal and impact printers. Ink jet printers include those that are thermally actuated (e.g., resistive element) and those that are mechanically actuated (e.g., piezo-electric element). Representative ink jet printers include those made by Hewlett Packard, Canon and Epson, etc. The electromagnetic interference (EMI) reducing techniques of the present invention are applicable to all printers and particularly to ink jet printers.

Advances in semiconductor fabrication and printhead design have led to an increase in the number of firing chambers provided on a single printhead. In a representative prior art printhead each of the plurality of firing chambers or subset thereof, may be fired simultaneously.

Increases in the number of firing chambers on each printhead lead to an increase in the resolution of a printed image and may result in improvements of both image quality and the rate at which an image (or document) is printed.

While the ability to fire multiple printheads simultaneously is advantageous in delivering ink to a desired destination (e.g., a sheet of paper), multiple simultaneous firings are disadvantageous in that they generate a significant amount of EMI due to the multiple simultaneous firing signal transitions. In other words, the firing signal for each firing chamber may change from an off state to a drive state simultaneously (i.e., large current change $\Delta i$ in a small time change $\Delta t$), causing the firing signal conductors to function as de-facto antennas that radiate electromagnetic interference generated by the abrupt signal transitions. Excess EMI causes interference with or the failure of system components and impedes receiving approval from the FCC and like international agencies that set EMI emission standards.

This problem is exacerbated by continuing efforts to increase firing chamber densities. Not only do higher density circuits have more EMI generator points, but they are also more likely to be adversely affected by the deleterious effects of EMI.

SUMMARY OF THE INVENTION

Accordingly, it is an object of the present invention to provide a multiple firing chamber ink jet printhead that modifies the timing of firing signals to the firing chambers to reduce EMI.

It is another object of the present invention to provide a multiple firing chamber printhead that delays at least some the firing signals relative to one another so as to reduce the occurrence of simultaneous firing signal transitions.

It is also an object of the present invention to provide such a multiple firing chamber printhead in which the induced delays are sufficient to achieve non-simultaneous firings that reduce EMI, while not being long enough to adversely affect image quality.

It is also an object of the present invention to provide a printer that incorporates such a printhead.

These and related objects of the present invention are achieved by use of a reduced EMI printhead apparatus and method as described herein.

The attainment of the foregoing and related advantages and features of the invention should be more readily apparent to those skilled in the art, after review of the following more detailed description of the invention taken together with the drawings.

DETAILED DESCRIPTION

Figure 1:
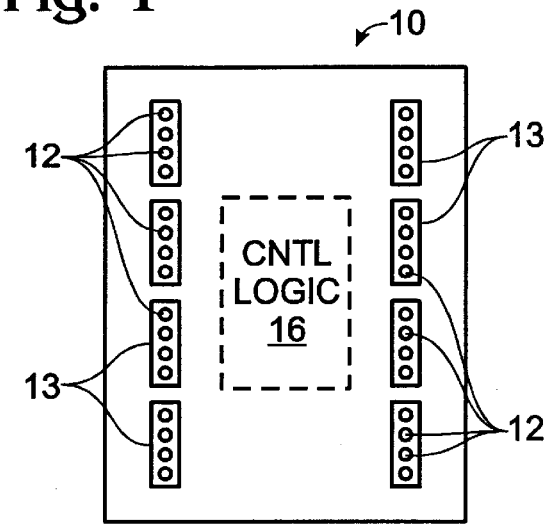
FIG. 1 is a top view of a printhead in accordance with the present invention.

Referring to FIG. 1, a top view of a printhead in accordance with the present invention is shown. Printhead 10 includes a plurality of nozzles 12 through which ink is ejected onto a page or other printable surface. A firing chamber (not shown in the perspective of FIG. 1) is preferably provided under each nozzle. The nozzles may be grouped in primitives 13 which are subsets of nozzles in which only one nozzle (or less than all nozzles) is fired per firing interval. While FIG. 1 illustrates four nozzles per primitive, more of less than this number may be provided. The use of primitives may decrease power consumption and lead interconnects and may address fluidic concerns.

Firing signal control logic 16 is shown in phantom lines to indicate that this control logic may be provided on or off (or in-part on or off) the die. In a preferred embodiment, the control logic is provided substantially on the printhead die.

Figure 2:
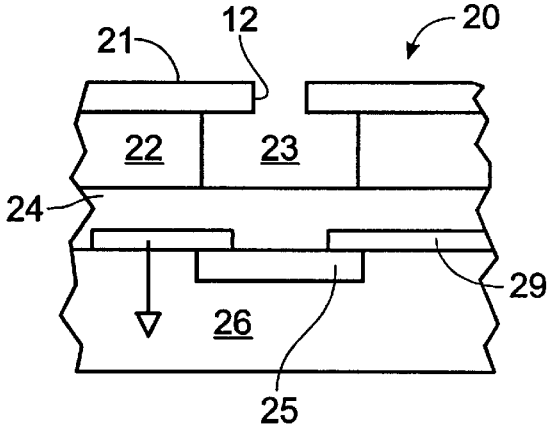
FIG. 2 is a cross-sectional view of a representative firing chamber for use with the printhead of FIG. 1.

Referring to FIG. 2, a cross-sectional view of a representative firing chamber 20 for use with the printhead of FIG. 1 is shown. The term firing chamber refers generally to the collection of components that expel an ink drop. Suitable firing chambers are known in the art and include firing chambers having different components and configurations than shown in FIG. 2. Firing chamber 20 includes an orifice layer 21, in which nozzle 12 is formed, a barrier layer 22 that helps define ink well 23, a passivation layer (or like protection layer) 24 and an ink expulsion element 25 such as a resistor or mechanical actuator or the like. A firing signal is delivered to the expulsion element via conductive material 29. The above components are preferably formed on a semiconductive substrate 26.

Figure 3:
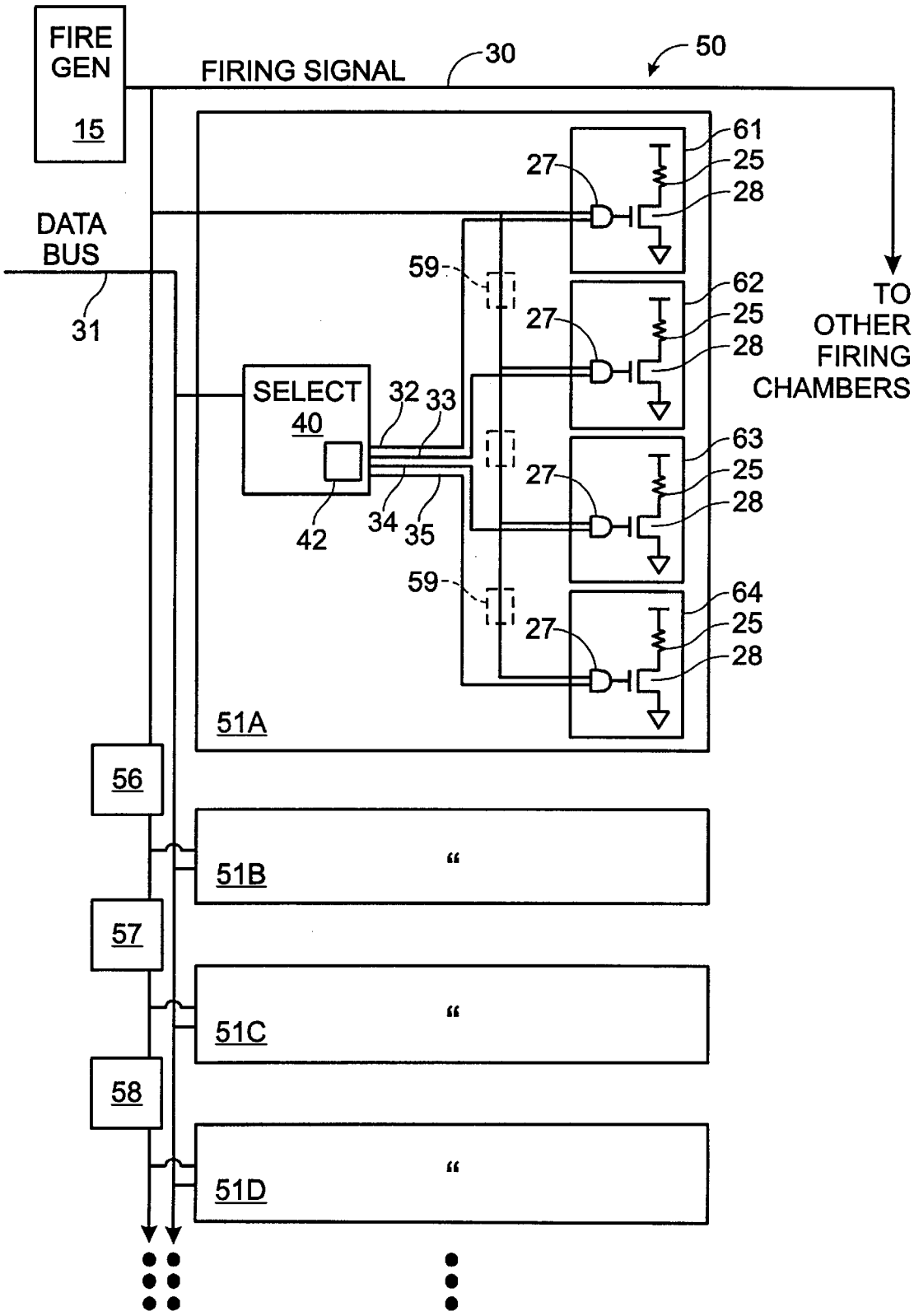
FIG. 3 is a schematic diagram of firing signal processing logic in accordance with the present invention.

Referring to FIG. 3, a schematic diagram of firing signal processing logic 50 in accordance with the present invention is shown. Logic 50 preferably includes a processing cell 51 (51A, 51B, 51C, 51D, etc.) for each primitive. In a printhead that does not utilize primitives, one or more processing cells 51 would preferably be configured to accommodate (i.e., provide appropriate delays to) the multiple firing chambers.

In the embodiment of FIG. 3, four processing cells 51A–51D are shown. Since these cells are essentially the same, except for the nozzle select data loaded from the data bus, only one cell, cell 51A, is shown and described in detail. It is to be understood that cell 51B–51D (and other cells) are preferably configured in a manner similar to cell 51A.

In one preferred embodiment, a "global" firing signal is provided onto signal line 30 by firing signal generating logic 15. Suitable firing signal generating logic is known in the art and for purposes of the present discussion, each cycle of the global firing signal defines a firing interval. The global firing signal is delivered to each cell 51A–51D and to a firing chamber AND gate 27 (or other suitable logic) associated with each firing chamber. An ink expulsion element 25 such as a resistor (for a thermally actuated ink jet printer) and a transistor 28 for gating the resistor are also preferably provided with each firing chamber.

Select logic 40 provides within each cell 51A–51D determines which of the plurality of firing chambers within a processing cell actually fires during a given firing interval. Select logic 40 preferably receives data via data bus 31 that indicates which firing chamber should fire during a given firing interval. This data is provided by known control logic and preferably loaded into register 42 or the like. From register 42 an appropriate signal is delivered over conductors 32–35, respectively, to the AND gates 27 of firing chambers 61–64. The signal output from each of the respective AND gates is the firing signal of its corresponding firing chamber 61–64.

As alluded to in the Background of the Invention section, if a firing signal is generated simultaneously for firing chambers in each cell (or more than one firing chamber per cell), then a significant amount of EMI is produced by the multiple simultaneous signal transitions (i.e., large $\Delta i$ per small $\Delta t$). In accordance with the present invention, a plurality of delay elements 56,57,58 are provided in the global firing signal path between each cell 51A–51D to modify and preferably stagger the timing at which the firing signal is received at each cell. An amount of delay is preferably selected that results in a desired level of EMI suppression without noticeably affecting image quality. It should be recognized that if processing logic 50 is configured such that more that one firing chamber per primitive is fired per firing interval, then delay elements could be provided between those firing chambers. Such delays are shown in phantom lines and labeled with reference number 59.

Figure 4:
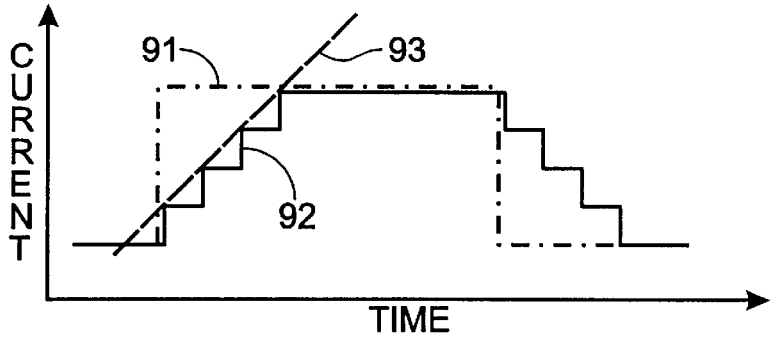
FIG. 4 is a diagram of delayed and non-delayed firing scenarios.

Referring to FIG. 4, a diagram of delayed and non-delayed firing scenarios is shown. Line 91 represents the change in current due to simultaneous delivery of the global firing signal to a plurality of four processing cells. Line 92 represents the change in current due to staggered firing signals (due to delay elements 56–58) and line 93 represents a linear approximation of the stepped increases. It is apparent from FIG. 4 that lines 92 and 93 indicate a significantly more gradual transition from an off-state to a fire-state and this gradual transition results in far less EMI generation than the abrupt transition of line 91.

Figure 5:
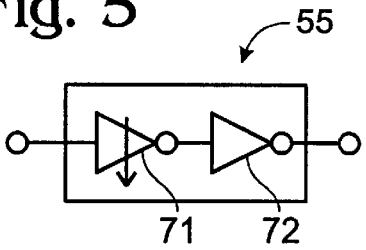
FIG. 5 is a schematic diagram of a delay element in accordance with the present invention.

Referring to FIG. 5, a schematic diagram of one embodiment of a delay element (56–58 or 55) in accordance with the present invention is shown. Each of delay elements 56–59 of FIG. 3 may be implemented as the delay element of FIG. 5 (or FIG. 7 below). A common reference numeral 55 is used to refer to each of these delay elements. The delay element 55 of FIG. 5 preferably includes a first inverter 71 and a second inverter 72. A characteristic of the embodiment of FIG. 5 (and of FIG. 7 below and other potential delay elements) is that the element of FIG. 5 is preferably capable of generating a sufficiently short delay such that image quality is not adversely affected. The delay of element 55 is preferably orders of magnitude less than the firing interval. For example, if the firing interval is in the microsecond range (0–999), then the delay of element 55 is preferably in the nanosecond range (0–999).

This may be achieved by use of a first inverter that has weak fanout or drive capability and a second inverter that has adequate fanout capabilities. As a weak inverter (low fanout), inverter 71 requires time (i.e., delay) to charge the input capacitance of the second inverter. The amount of delay can be determined by the drive strength of the first inverter. The second inverter also functions to correct the polarity of the signal output from the first inverter.

Figure 6:
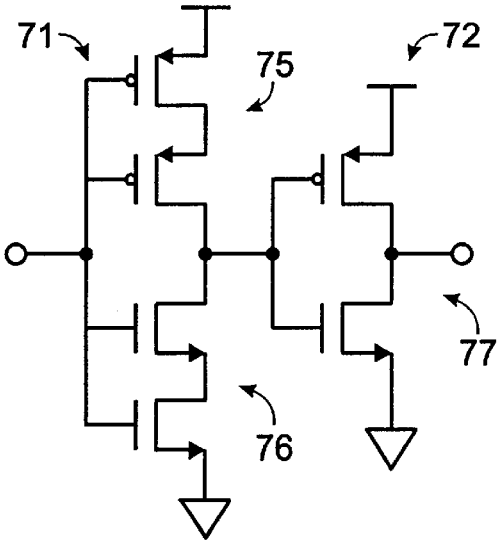
FIG. 6 is one embodiment of a CMOS implementation of the delay element of FIG. 5 in accordance with the present invention.

Referring to FIG. 6, a diagram of one embodiment of a CMOS implementation of delay device 55 of FIG. 5 in accordance with the present invention is shown. Inverter 71 is preferably created in a "weak" state while inverter 72 is preferably implemented as a good driver. A weak state may be generated by using a double CMOS transitor 75,76 embodiment as shown that effectively doubles the gate length. Alternatively, the gate widths of the NMOS and PMOS transitor(s) of inverter 71 may be reduced to in turn reduce the current passed by the inverter. Inverter 72 preferably has a standard or enhanced gate CMOS transistor 77 that supports fanout.

Figure 7:
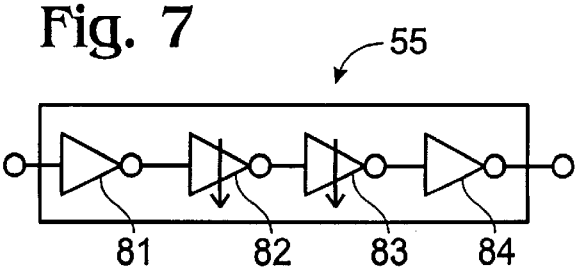
FIG. 7 is a schematic diagram of an alternative embodiment of a delay element in accordance with the present invention.

Referring to FIG. 7, an alternative embodiment of a delay element 55 in accordance with the present invention is shown. Delay element 55 of FIG. 7 includes four inverters 81–84. The second and third inverters 82,83 are preferably "weak" as discussed above. The first and fourth inverters 81,84 are preferably standard inverters, though the first inverter 81 preferably has a low input capacitance and the fourth inverter 84 preferably has good fanout capabilities. The two weak inverters preferably provide a suitable delay, while the first and fourth inverters provide isolation. Isolation inverters 81 and 84 in conjunction with delay inverters 82 and 83 achieve a defined delay, substantially regardless of what is driving delay element 55 and what is being driven by delay element 55. Delay element 55 of FIG. 7 may be implemented in CMOS in a manner similar to element 55 of FIGS. 5 and 6. Implementation of delay element 55 with inverting buffers achieves desired delay in a relatively small physical area.

While inverting buffers are described above as a preferred manner of implementing delays (or staggering firing signals), it should be recognized that firing signal staggering (or otherwise modifying the firing signal timing to reduce EMI) may be achieved by many circuit arrangements/components. These include but are not limited to, a phase-locked loop (controlled current and matched capacitor), a precision RC time constant, a reference threshold op-amp, etc. Digital control logic that staggers firing signals or the like (as opposed to a global signal) could also be used provided that the master clock signal or the like is sufficiently fast. As noted above, the selected delay element must achieve minimum delay criteria.

Figure 8:
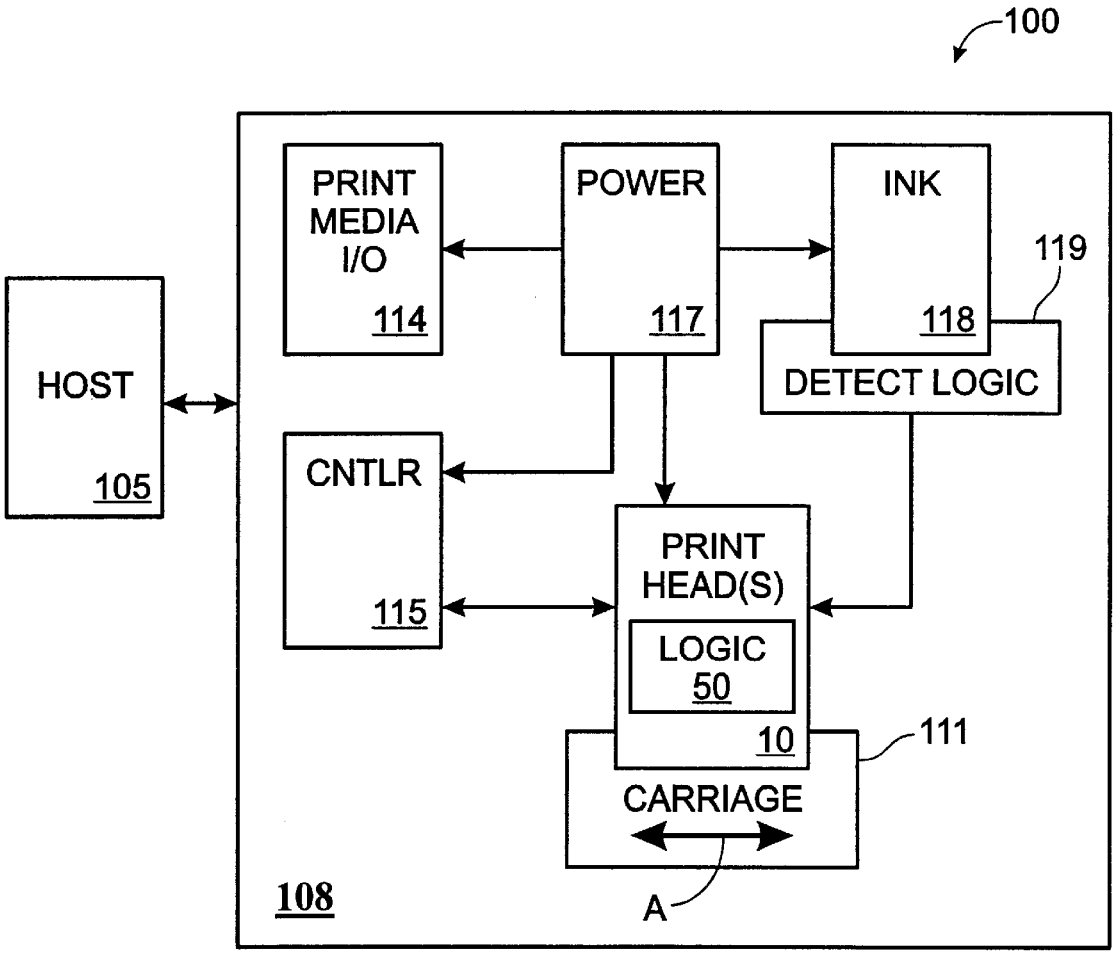
FIG. 8 is a schematic diagram of a printer in accordance with the present invention.

Referring to FIG. 8, a schematic diagram of a printing system 100 that incorporates printhead 10 and logic 50 in accordance with the present invention is shown. Printer system 100 includes a host machine 105 that is coupled to a printer 108. The host machine may be a computer, facsimile machine, Internet terminal or other print data generating device.

Printer 108 preferably includes printhead 10 which is preferably mounted on a carriage 111. Carriage 111 provides movement of the printhead across print media. Two headed arrow A indicates transverse movement of printhead 10. Printhead 10 is coupled to a controller 115 that provides processing signals. Controller 115 is coupled to host machine 105 and may be coupled to other printer components, for example, to indicate ink or paper out conditions, etc., to the host. Suitable carriage and controller configurations are known in the art.

Printer 108 also includes an ink supply 118. Ink supply 118 may be formed integrally with printhead 10 or formed separately. Ink supply 118 may be provided in a refillable or replaceable manner. Ink level detection logic 119 is preferably provided with ink supply 118.

Printer 108 also preferably includes a print media input/output (I/O) unit 114. Print media may include paper, Mylar and any other material onto which printhead 10 may expel ink. Print media I/O unit 114 preferably provides a receptacle for pre-printed and post-printed media and a mechanism for transport of print media between these two receptacles. Power supply 117 delivers appropriate power to the printhead, controller, ink supply (and ink level detection logic) and the print media I/O unit.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A printhead apparatus, comprising:

a first firing signal conductor coupled to a first ink expulsion element;

a second firing signal conductor coupled to a second ink expulsion element; and a delay element provided in said second firing signal conductor for delaying a firing of said second ink expulsion element relative to said first ink expulsion element within the same firing interval so as to reduce the EMI produced by a change in state of firing signal current in said first and second firing signal conductors.

2. The printhead apparatus of claim 1, wherein said delay element produces a delay of less than a microsecond.

3. The printhead apparatus of claim 1, wherein said first and second firing signal conductors have a common source and said delay element is provided in said second conductor between said common source and said second ink expulsion element.

4. The printhead apparatus of claim 1, further comprising:

a third firing signal conductor coupled to a third ink expulsion element;

a fourth firing signal conductor coupled to a fourth ink expulsion element;

a delay element provided in said third firing signal conductor for delaying a firing of said third ink expulsion element relative to another of said ink expulsion elements; and a delay element provided in said fourth firing signal conductor for delaying a firing of said fourth ink expulsion element relative to another of said ink expulsion elements.

5. The apparatus of claim 4, wherein the delay elements of said second, third and fourth firing signal conductors function to achieve an at least partial staggered firing of said first, second, third and fourth ink expulsion elements during the same firing interval.

6. The apparatus of claim 1, wherein said delay element includes a buffer that induces a desired delay.

7. The apparatus of claim 1, wherein said delay element includes at least a first buffer that facilitates achievement of a desired delay and a second buffer that facilitates achievement of a desired fanout.

8. The apparatus of claim 1, wherein said first ink expulsion element is provided in a first primitive and said second ink expulsion element is provided in a second primitive, and said delay element is provided between said first and second primitives.

9. The apparatus of claim 1, further comprising at least one of the group of elements including:

a printer controller;

a print media I/O unit;

an ink supply;

a power supply; and a movable printhead carriage.

10. The apparatus of claim 1, wherein said second signal conductor is coupled between said first signal conductor and said second ink expulsion element.

11. The apparatus of claim 1, wherein said delay element provides analog delay.

12. A printhead apparatus, comprising:

a first ink expulsion element;

a second ink expulsion element; and a mechanism that staggers firing of said first and second ink expulsion elements within a firing interval so as to reduce the EMI that a simultaneous firing of said first and second ink expulsion elements would produce;

wherein said staggered firing mechanism includes an analog delay element for creating a delay between the respective firings of said first and second ink expulsion elements.

13. The apparatus of claim 12, wherein said apparatus includes a plurality of N ink expulsion elements that receive a firing signal from a firing signal conductor, where N is an integer greater than 2; and a plurality of N−1 delay elements that are coupled within said firing signal conductor substantially sequentially between said N ink expulsion elements so as to achieve said staggered firings.

14. The apparatus of claim 12, wherein said delay is less than one microsecond.

15. The apparatus of claim 12, wherein said delay element includes a first and a second buffer that achieve both sufficient delay to reduce EMI and sufficient fanout to drive downstream components.

16. The apparatus of claim 12, further comprising at least one of the group of elements including:

a printer controller;

a print media I/O unit;

an ink supply;

a power supply; and a movable printhead carriage.

17. A printhead apparatus, comprising:

a first ink expulsion element;

a second ink expulsion element; and a mechanism that staggers firing of said first and second ink expulsion elements within a firing interval so as to reduce the EMI that a simultaneous firing of said first and second ink expulsion elements would produce;

wherein said staggered firing mechanism includes a delay element for creating a delay between the respective firings of said first and second ink expulsion elements; and wherein the delay induced by said delay element is sufficient to reduce EMI but does not noticeably affect image quality.

18. A method of printing, comprising the steps of:

providing a plurality of firing chambers;

providing a plurality of firing signals, one each to each of said firing chambers; and staggeredly delivering said plurality of firing signals to their respective firing chambers during a firing interval in such a manner as to reduce EMI caused by signal transitions in the firing signals but to not noticeably affect image quality as perceived by a human eye.

19. The method of claim 18, wherein said staggeredly delivering step includes the step of delaying a firing of at least one of said plurality of said firing chambers relative to another of said plurality of firing chambers.

20. The method of claim 18, further comprising the steps of:

providing a plurality of delay elements in said firing signal conductor so as to create a delay in time between when a signal transition in said firing signal conductor is received at each of said plurality.

* * * * *

UNITED STATES PATENT AND TRADEMARK OFFICE

CERTIFICATE OF CORRECTION

PATENT NO. : 6,375,295 B1
DATED : April 23, 2002
INVENTOR(S) : Ghozeil et al.

It is certified that error appears in the above-identified patent and that said Letters Patent is hereby corrected as shown below:

Column 8,
Line 11, after "of" insert the following:
-- providing a firing signal conductor that is coupled to each of said firing chambers; and --

Signed and Sealed this

Sixth Day of July, 2004

JON W. DUDAS
*Acting Director of the United States Patent and Trademark Office*